US006841010B2

(12) United States Patent
Strezov et al.

(10) Patent No.: US 6,841,010 B2
(45) Date of Patent: Jan. 11, 2005

(54) COLD ROLLED STEEL

(75) Inventors: Lazar Strezov, Adamstown Heights (AU); Kannappar Mukunthan, Merewether (AU)

(73) Assignee: Castrip, LLC, Charlotte, NC (US)

( * ) Notice: Subject to any disclaimer, the term of this patent is extended or adjusted under 35 U.S.C. 154(b) by 0 days.

(21) Appl. No.: 10/329,869

(22) Filed: Dec. 26, 2002

(65) Prior Publication Data

US 2003/0106621 A1 Jun. 12, 2003

Related U.S. Application Data

(62) Division of application No. 09/889,081, filed as application No. PCT/AU00/00010 on Jan. 11, 2000, now Pat. No. 6,558,486.

(30) Foreign Application Priority Data

Jan. 12, 1999 (AU) ..... PP8113

(51) Int. Cl.[7] ..... C22C 38/02; C22C 38/04; C22C 38/06

(52) U.S. Cl. ..... 148/320

(58) Field of Search ..... 148/320

(56) References Cited

U.S. PATENT DOCUMENTS 3,963,531 A 6/1976 Elias et al.

FOREIGN PATENT DOCUMENTS

| | | | | |
|---|---|---|---|---|
| DE | 3105891 A | | 9/1982 | |
| EP | 0 073 092 A | | 4/1982 | |
| JP | 357185928 A | * | 11/1982 | ..... 148/651 |

* cited by examiner

*Primary Examiner*—Deborah Yee
(74) *Attorney, Agent, or Firm*—Barnes & Thornburg LLP

(57) ABSTRACT

A steel strip is produced having a tensile strength of at least 680 MPa but is such that the total elongation to break off of the strip after annealing is in the range 9% to 12%. Cold rolling may produce a cold reduction of the strip thickness in the range 40% to 80%. The continuously cast strip may be optionally in-line hot rolled prior to coiling to produce an initial strip thickness in the range 40% to 60%.

18 Claims, 13 Drawing Sheets

COLD ROLLED STEEL

CROSS-REFERENCE TO RELATED APPLICATIONS

This application is a division of U.S. Ser. No. 09/889,081, filed Aug. 31, 2001 now U.S. Pat. No. 6,558,486, issued May 6, 2003, assigned to the same assignee as this application and now incorporated herein by reference, and which is a U.S. national counterpart application of international application serial No. PCT/AU00/00010 filed Jan. 11, 2000, and which claims priority to and the benefit of Australian provisional application serial No. PP 8113 filed Jan. 12, 1999.

BACKGROUND AND SUMMARY OF THE INVENTION

The invention provides a method of producing plain carbon steel strip which has an excellent balance of ultimate tensile strength and elongation to break making it particularly suitable for the production of structural steel products. Strip produced in accordance with the invention may for example be used as a feed material that is hot dip coated with zinc or aluminium/zinc alloys to produce roof decking, guttering and other structural steel products.

The term "strip" as used in the specification is to be understood to mean a product of 5 mm thickness or less.

Recent developments in continuous casting techniques have included the casting of steel strip by continuous casting in a twin roll caster. In this technique molten metal is introduced between a pair, of contra-rotated horizontal casting rolls which are internally water cooled so that metal shells solidify on the moving rolls surfaces and are brought together at the nip between them to produce a solidified strip product delivered downwardly from the nip between the rolls, the term "nip" being used to refer to the general region at which the rolls axe closest together. The molten metal may be poured from a ladle into a smaller vessel from which it flows through a metal delivery nozzle located above the nip so as to direct it into the nip between the rolls, so forming a casting pool of molten metal supported on the casting surfaces of the rolls immediately above the nip and extending along the length of the nip. This casting pool is usually confined between side plates or dams held in sliding engagement with end surfaces of the rolls so as to dam the two ends of the casting pool against outflow, although alternative means such as electromagnetic barriers have also bean proposed. The casting of steel strip in twin roll casters of this kind is for example described in U.S. Pat. Nos. 5,184,668, 5,277,243 and 5,934,359.

We have determined that it is possible by continuous strip casting to produce strip which is highly susceptible to work hardening by cold rolling, ie. the ultimate tensile strength of the strip can be dramatically increased by moderate cold rolling. It has been further found that this work hardening effect is particularly pronounced in the case of silicon/manganese killed plain carbon steel, and increases with increasing manganese and silicon contents in the steel chemistry. Silicon/manganese killed steels are particularly suited to twin roll strip casting since aluminium killed or partially killed steels cannot be cast satisfactorily due to formation of solid inclusions which agglomerate and clog the fine flow passages in the metal delivery system of the caster to produce effects and discontinuities in the resulting strip product. A silicon/manganese killed steel will generally have a manganese content of not less than 0.20% (typically about 0.6%) by weight and a silicon content of not less than 0.10% (typically about 0.3%) by weight.

By an extensive test program we have determined that it is possible by cold rolling continuously cast plain carbon steel strip to produce a strip with an ultimate tensile strength of at least 680 MPa and an elongation-to-break in the range 8% to 12% which is an excellent balance of properties for use in many structural steel products such as roof decking and guttering.

So far as the applicants are aware, prior to the subject invention, it has not been possible to produce hot dip coated steel strip having this combination of properties from plain carbon steel and, as a consequence, it has been necessary to produce the steel strip from sore expensive grades of steel, such as low alloy steels which include specific additions of strengthening elements.

One known type of plain carbon steel strip that is used as a feed material for hot dip coating with aluminum/zinc alloys is produced by BHP Steel (JLS) Pty Ltd under the code name G550. G550 steel strip is produced by casting plain carbon steel slabs, hot rolling the slabs to form strip and thereafter coiling the strip, uncoiling and thereafter cold rolling the strip to a final product size of 0.25–2 mm, and heat treating the cold rolled strip to produce the final product. G550 steel strip has a guaranteed minimum ultimate tensile strength of 550 MPa and in a number of instances has ultimate tensile strengths above 700 MPa. For example, one commercially available G550 steel strip (Zincalume G550 coated steel) that is produced from plain carbon steel and is used for roof decking has an ultimate tensile strength of 680–780 MPa (based on a test sample of 0.42 mm thickness and an original gauge length of 80 mm). However, this G550 steel strip only has an elongation-to-break of 1–6%. The present invention enables production of a plain carbon steel strip of comparable tensile strength but an even better elongation-to-break.

According to the present invention there is provided a method of producing steel strip, comprising continuously casting plain carbon steel into a strip of no more than 5 mm thickness, coiling the strip;

uncoiling the strip;

cold rolling the uncoiled strip; and annealing the cold rolled strip to produce a stress relieved microstructure therein;

wherein the cold rolling produces a cold reduction in a range which is sufficient to increase the tensile strength of the strip to at least 680 MPa but such that the total elongation to break of the strip after said annealing is in the range 8% to 12%.

The tensile strength of the strip may be at least 700 MPa.

The continuous strip casting step may be carried out by means of a twin roll strip caster.

The term "plain carbon steel" is understood to mean steel of the following composition, in weight percent:

| | |
|---|---|
| C: | 0.02–0.08; |
| Si: | 0.5 or less; |
| Mn: | 1.0 or less; |

residual/incidental impurities: 1.0 or less; and

Fe: balance.

The term "residual/incidental impurities" covers levels of elements, such as copper, tin, zinc, nickel, chromium, and molybdenum, that may be present in relatively small amounts, not as a consequence of specific additions of these elements but as a consequence of standard steel making. By way of example, the elements may be present as a result of using scrap steel to produce plain carbon steel.

The term "residual/incidental impurities" excludes:

(a) amounts of the elements silicon and manganese outside the ranges given with definition of "plain carbon steel"; and (b) amounts of elements, such as the elements listed in the preceding paragraph that are specifically added to the steel for the purpose of strengthening the steel.

The plain carbon steel may be silicon/manganese killed and may have the following composition by weight:

| | |
|---|---|
| Carbon | 0.02–0.08% |
| Manganese | 0.30–0.80% |
| Silicon | 0.10–0.40% |
| Sulfur | 0.005–0.05% |
| Aluminium | less than 0.01% |

A typical composition is as follows:

| | |
|---|---|
| Carbon | 0.06% |
| Manganese | 0.66% |
| Silicon | 0.324 |
| Sulphur | 0.01% |

Total oxygen content 60 ppm @ 1600° C.

The cold rolling may produce a cold reduction of the strip thickness in the range 40% to 80%.

The annealing may produce the stress relieved microstructure with no more than 10% recrystallisation and an elongation-to-break of at least 10%.

The annealing temperature may be at least 450° C. and may be in the range 500° C. to 600° C.

Optionally, the continuously cast strip may be in-line hot rolled to reduce the thickness of the strip prior to coiling. It is desirable that the hot rolling produce a thickness reduction of no more than 40%.

In cases where the strip is hot rolled, it is desirable that the subsequent cold rolling produces a cold reduction of the strip in the range 40% to 60%.

The invention further provides a plain carbon steel strip having an ultimate tensile strength of at least 700 MPa and an elongation to break in the range of 8% to 12%.

BRIEF DESCRIPTION OF TEE DRAWINGS

In order that the invention may be more fully explained, some examples will be described with reference to the accompanying drawings, in which.

FIGS. 4 to 13 provide test data obtained from a series of experiments in which plain carbon steel strips cast in a twin roll caster were subjected to cold roll reduction, and in some cases to initial in-line hot rolling, and were subsequently annealed at various annealing temperatures.

DETAILED DESCRIPTION OF THE DRAWINGS

Figure 1:
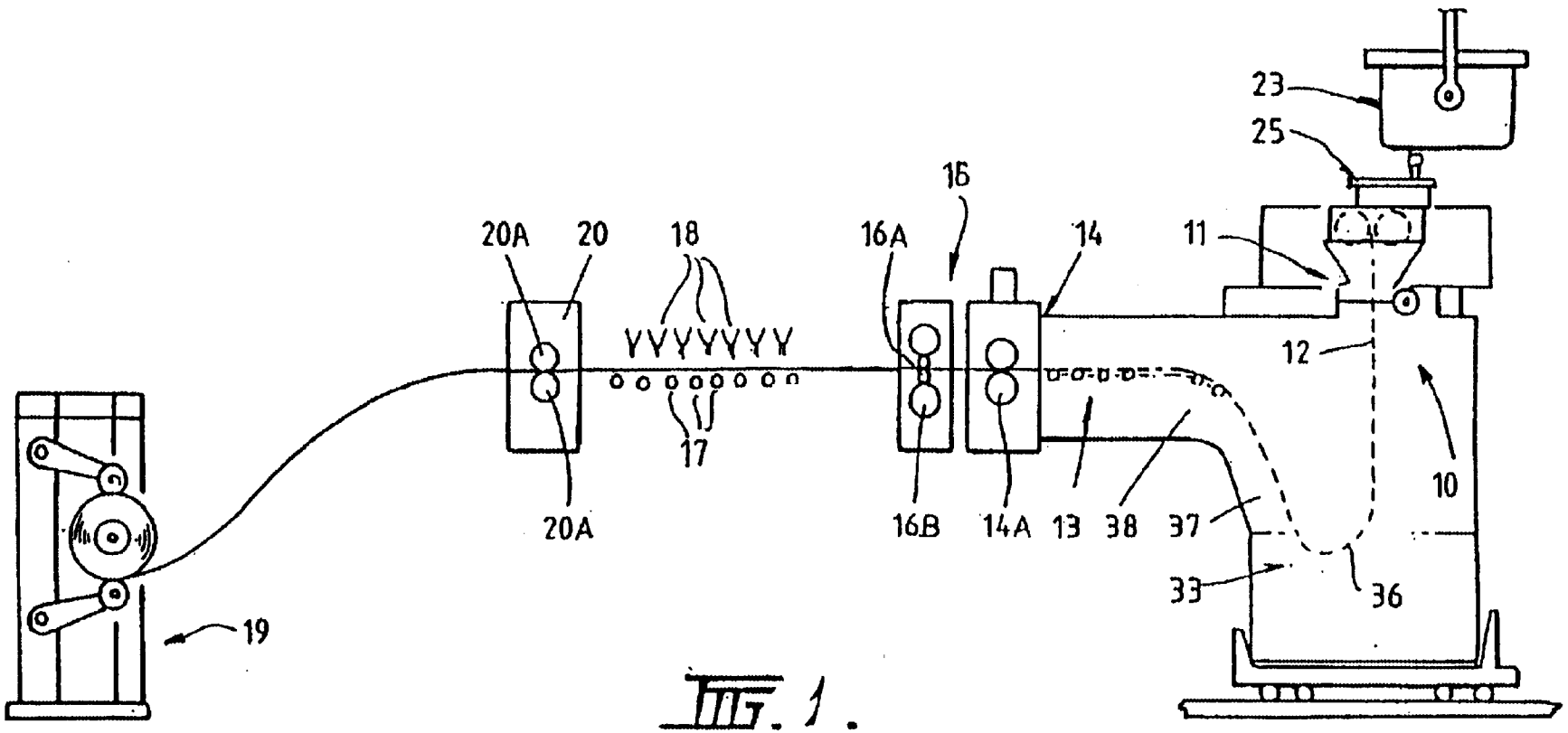
FIG. 1 illustrates a strip casting installation incorporating an in-line hot rolling mill and coiler.
Figure 2:
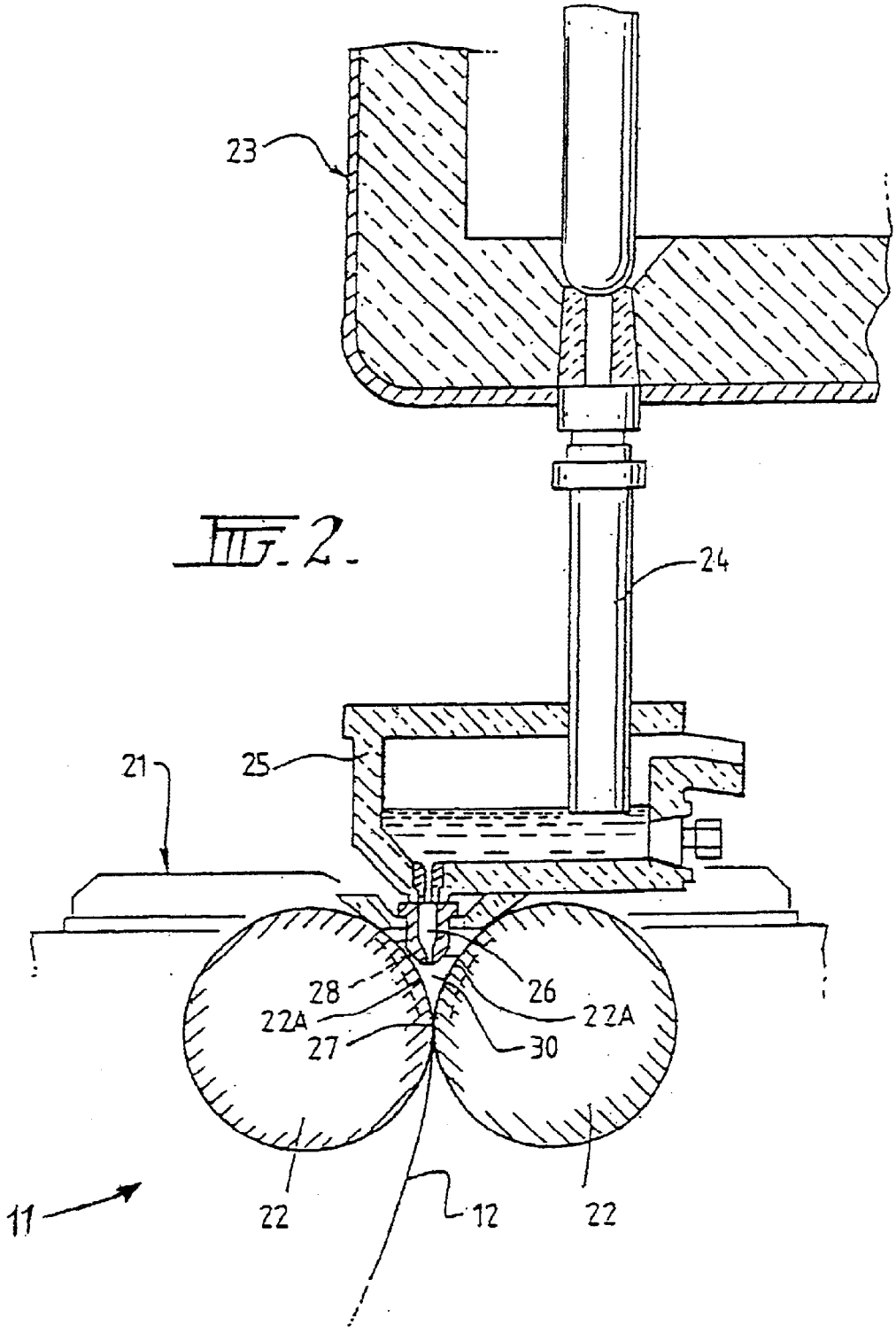
FIG. 2 illustrates details of the twin roll strip caster.
Figure 3:
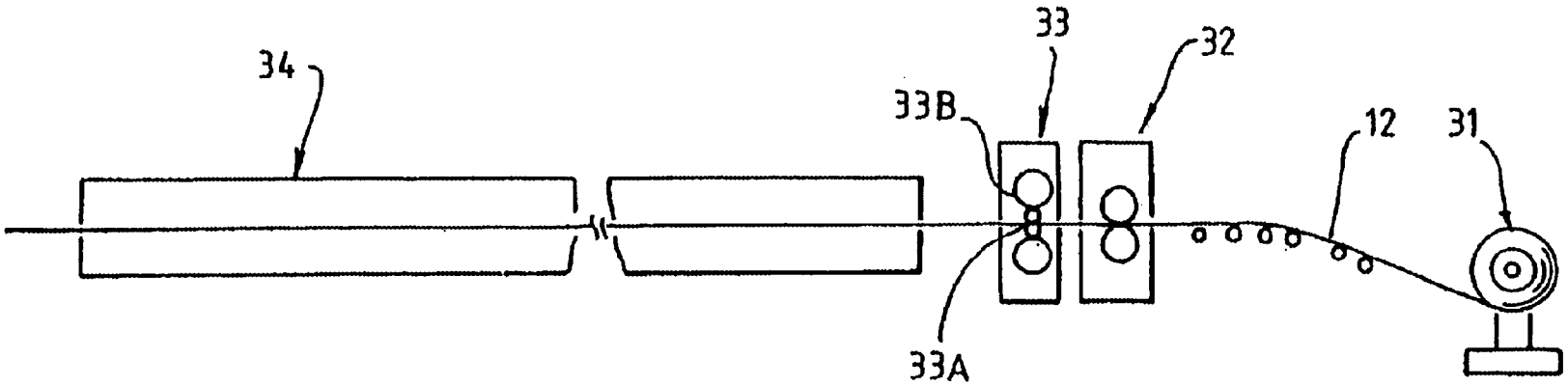
FIG. 3 illustrates an uncoiling and cold rolling installation.

FIGS. 1 and 3 illustrate successive parts of production line whereby steel strip can be produced in accordance with the present invention. FIGS. 1 and 2 illustrate a twin roll caster denoted generally as 11 which produces a cast steel strip 12 that passes in a transit path 10 across a guide table 13 to a pinch roll stand 14 comprising pinch rolls 14A. Immediately after exiting the pinch roll stand 14, the strip passes into a hot rolling mill 16 comprising a pair of reduction rolls 16A and backing rolls 16B in which it is hot rolled to reduce its thickness. The rolled strip passes onto a run-out table 17 on which it may be force cooled by water jets 18 and through a pinch roll stand 20 comprising a pair of pinch rolls 20A, and thence to a coiler 19.

As shown in FIG. 2, twin roll caster 11 comprises a main machine frame 21 which supports a pair of parallel casting rolls 22 having casting surfaces 22A. Molten metal is supplied during a casting operation from a ladle (not shown) to a tundish 23, through a refractory shroud 24 to a distributor 25 and thence through a metal delivery nozzle 26 into the nip 27 between the casting rolls 22. Molten metal thus delivered to the nip 27 forms a pool 30 above the nip and this pool is confined at the ends of the rolls by a pair of side closure dams or plates 28 which are applied to the ends of the rolls by a pair of thrusters (not shown) comprising hydraulic cylinder units connected to the side plate holders. The upper surface of pool 30 (generally referred to as the "meniscus" level) may rise above the lower end of the delivery nozzle so that the lower end of the delivery nozzle is immersed within this pool.

Casting rolls 22 are water cooled so that shells solidify on the moving roll surfaces and are brought together at the nip 27 between them to produce the solidified strip 12 which is delivered downwardly from the nip between the rolls.

The twin roll caster may be of the kind which is illustrated and described in some detail in U.S. Pat. Nos. 5,184,668 and 5,277,243 or U.S. Pat. No. 5,488,988 and reference may be made to those patents for appropriate constructional details which form no part of is the present invention.

FIG. 3 illustrates an uncoiler 31 by which a coil produced on the apparatus may be uncoiled. The uncoiled strip 12 is passed through a pinch roll stand 32 to a cold rolling mill 33 comprising reduction rolls 33A and backing rolls 33B and thence through an annealing enclosure 34.

The process of microstructure evolution in strip casting is fundamentally different from that in conventional hot strip mills. Hot strip mill products undergo large reduction which breaks up the original slab microstructure through enhanced recrystallisation kinetics resulting in significant refinement of austenite grains (approximately 20 microns), which upon transformation produce a fine equiaxed ferrite grain structure (approximately 10 microns—this is a completely polygonal microstructure). The austenite grain size (typically 150–250 microns in width and 500 microns in length) in cast strip is entirely governed by the casting process and such coarse austenite grains when transformed result in a mixed microstructure consisting of coarse polygonal ferrite grains (typically 10–50/50–250 microns width/length and 30–60% in volume fraction for standard cooling/coiling conditions) and relatively fine Widmanstatten/acicular ferrite. Scope for grain refinement is limited, primarily because the coarse austenite grains are inherently resistant to recrystallisation and also due to the fact that only a single hot rolling pass is available under normal strip casting plant layout. However, considerable amount of grain refinement is observed when the amount of hot reduction is greater than 30%, resulting in polygonal ferrite content of greater than 80% with grains in the range of 10–50 microns.

For the typical strip cast and strip cast/hot rolled microstructure occurring in silicon/manganese killed steels, we have observed enhanced work hardening by cold rolling. For example, 40% cold reduction is sufficient to increase the cold rolled tensile strength from about 420 MPa to greater than 750 MPa, resulting in a recovery annealed tensile strength of around 700 MPa. Because of this, products with tensile strength of 680 MPa and above can be obtained for a range of cold reductions, from 40% to as high as 80%; 40–60% are generally preferred because the elongation tends to suffer at high cold reductions.

The run-out-table cooling/coiling conditions determine the initial as-cast microstructure. The microstructure described previously is obtained under typical operating conditions; cooling rate of 10–20° C./s and coiling temperature of 600–700° C. These conditions usually result in total elongation values of 20–30% and such initial properties are ideal to produce strip with the necessary balance of tensile strength and elongation. For fast cooling and low coiling conditions (500° C. coiling temperature for example), the initial elongation can be as low as 15% and this will reduce the cold rolling range to produce the required elongation value in the final product. These considerations are demonstrated by the following experimental results.

A first series of experiments was carried out on samples of 2.17 mm thickness as-cast plain carbon steel strip cast at a casting speed of 34 m/min. The steel was a silicon/manganese killed steel with a carbon content of 0.06%. (by weight), a manganese content of 0.6%, a silicon content of 0.3% and a sulphur content of 0.01%.

The samples were divided into groups and were cold rolled to produce thickness reductions of 20%, 40%, 60%., 80% and 90%. A set of the samples from each group was then heat treated in a fluidised bed furnace for 60 seconds at 500° C. A further set of the samples from each group was heat treated for 60 seconds at 500° C. in the furnace. Finally, a third set of the samples from each group was heat treated for 60 seconds at 600° C. in the furnace. The cold rolled and annealed sets of samples and a fourth set of the cold rolled samples were then tested in a tensile testing machine to determine the ultimate tensile strengths and elongations-to-break of the samples. The tensile tests were carried out according to Australian Standard 1391 (AS1391). The test samples had a gauge length of 12 mm and a parallel length of 22 mm.

Figure 4:
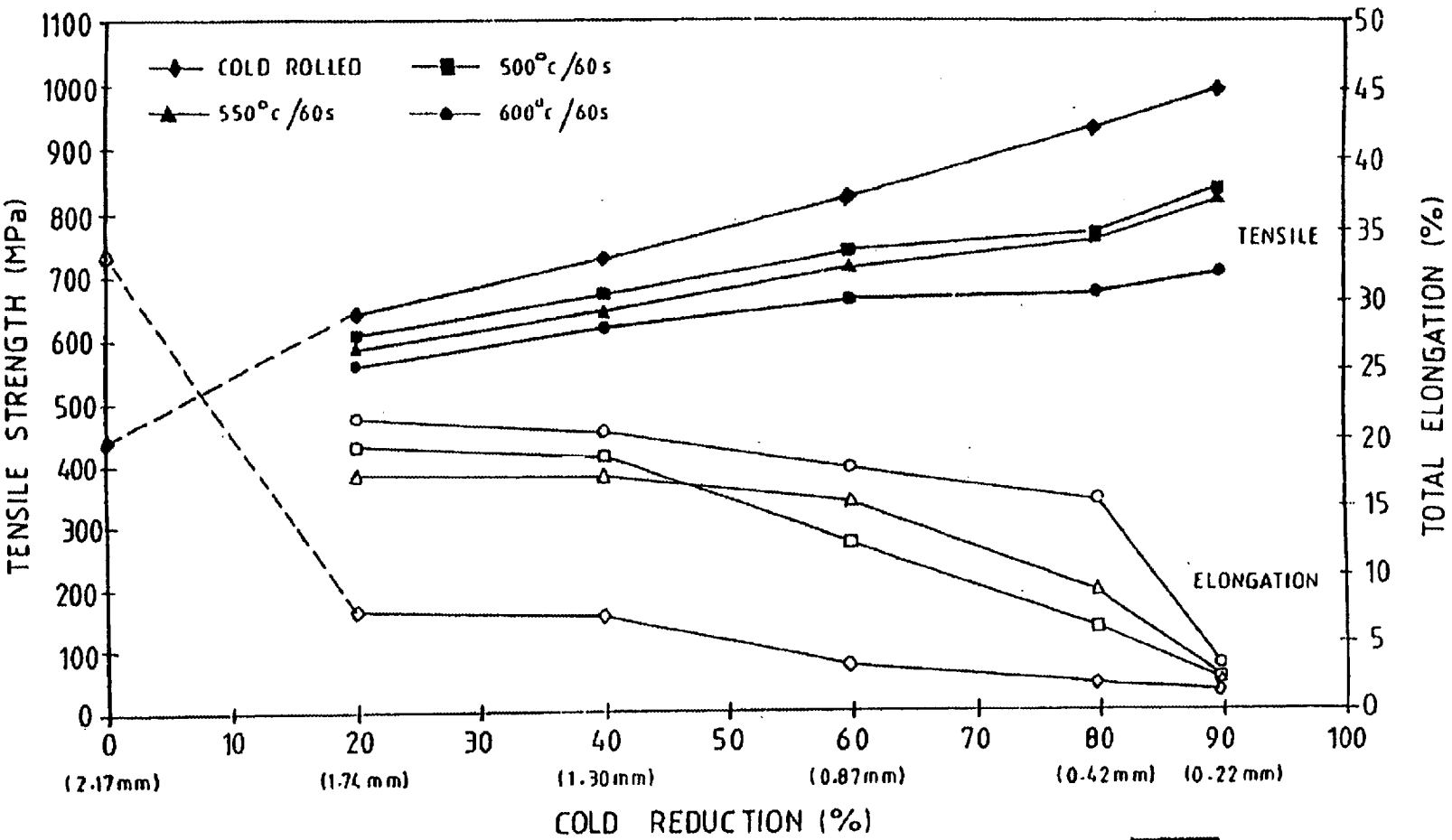

FIG. 4 is a graph of ultimate tensile strength and elongation-to-break versus cold reduction for the samples.

A second series of experiments was carried out on samples of 2.17 mm thickness as-cast plain carbon steel strip that were hot rolled at 865° C. to produce a thickness reduction of 36%. Samples from the hot rolled coil were then cold rolled and annealed as per the first series of experiments.

Figure 5:
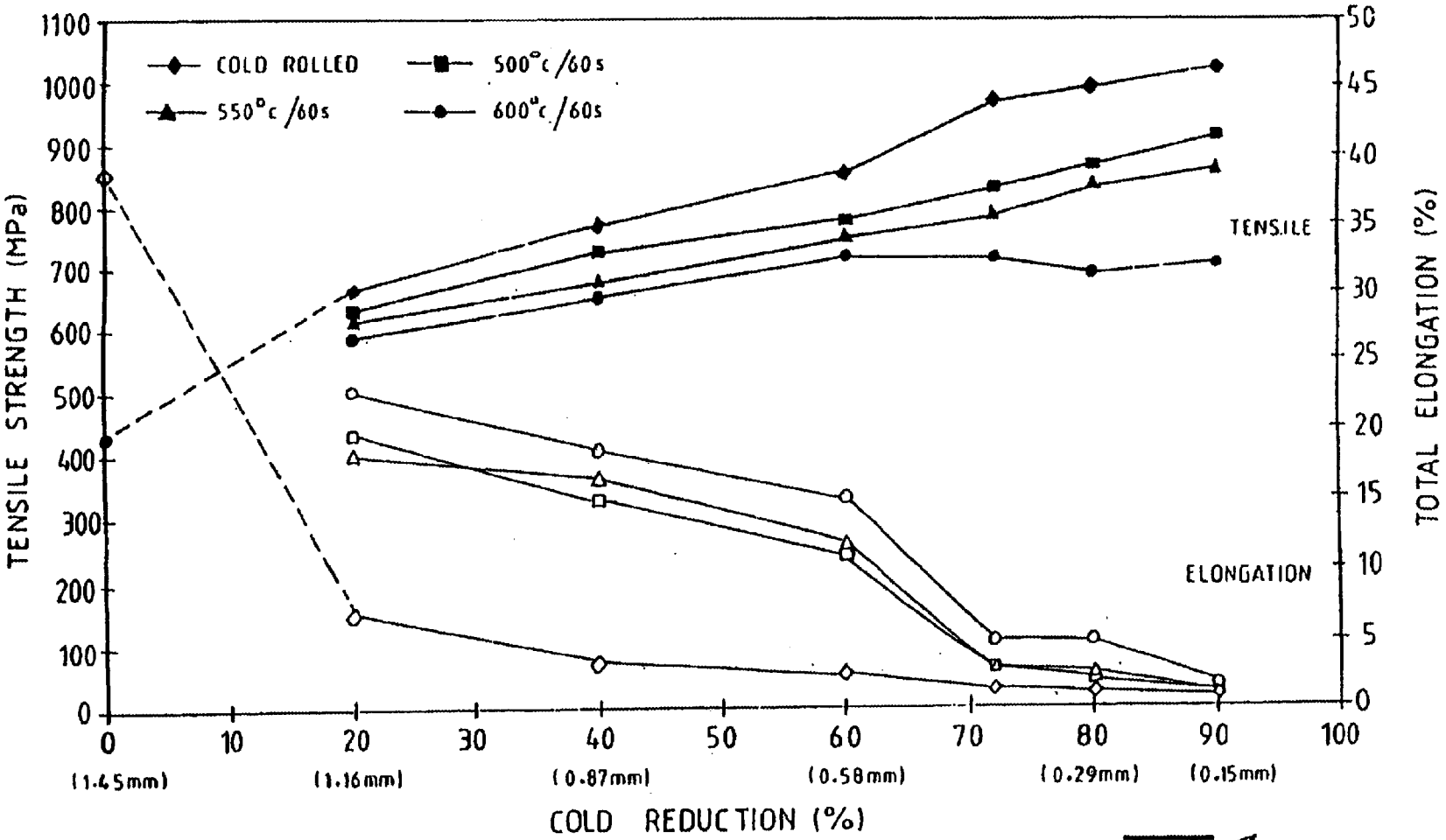

FIG. 5 is a graph of ultimate tensile strength and elongation-to-break versus cold reduction for the samples.

It can be seen from FIGS. 4 and 5 that by the method of the present invention it is possible to produce final products having ultimate tensile strengths of at least 680 MPa and an elongations-to-break of at least 10%.

By way of example, it can be seen from FIG. 4 that as-cast plain carbon steel strip that was cold rolled to a thickness reduction of 60% and then heat treated at 550° C. for 60 seconds had a ultimate tensile strength of approximately 720 MPa and an elongation-to-break of 15%.

By way of further example, it can be seen from FIG. 4 that as-cast plain carbon steel strip that was cold rolled to a thickness reduction of 60% and then heat treated at 500° C. for 60 seconds had a ultimate tensile strength of approximately 740 MPa and an elongation-to-break of approximately 12%.

FIGS. 4 and 5 demonstrate a significant drop in elongation occurring at 80% cold reduction for strip which is cold rolled in the as cast condition and at 60% cold reduction for the hot rolled strip. This indicates that when the strip is initially hot rolled, this will reduce the maximum allowable cold reduction with the minimum elongation-to-break of 8% is to be maintained.

Figure 6:
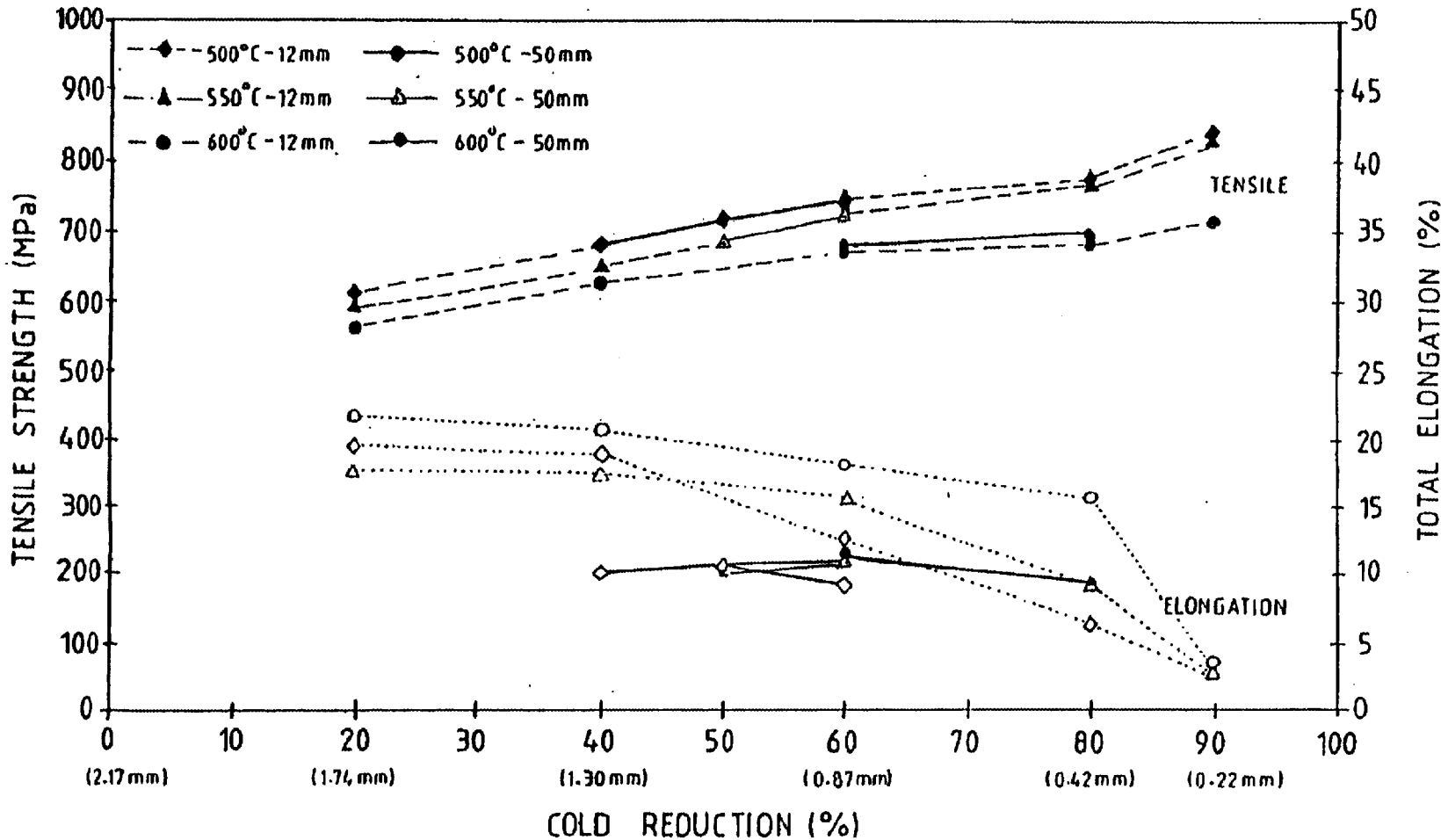
Figure 7:
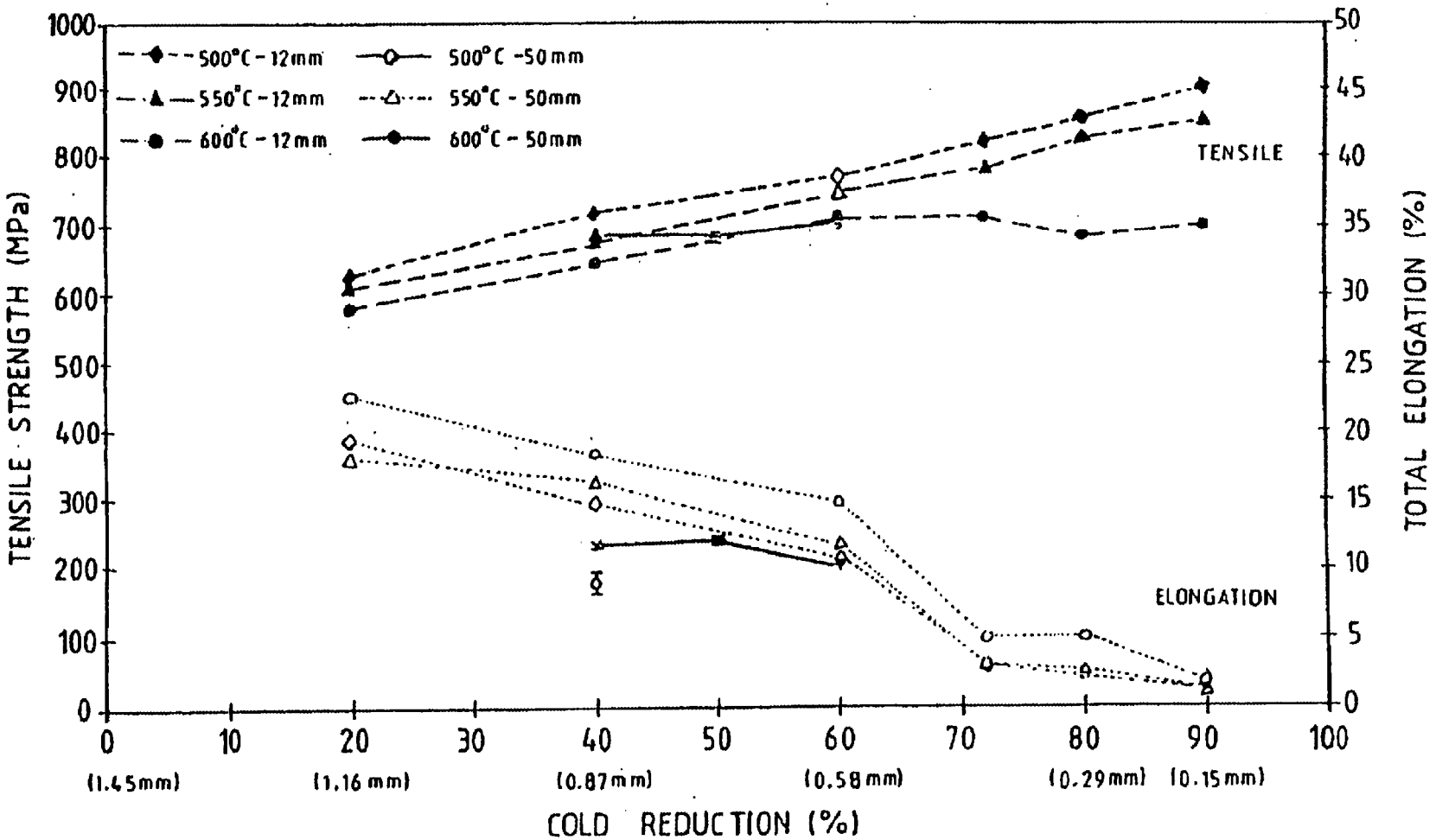

FIGS. 6 and 7 provide the same experimental data as previously presented in FIGS. 4 and 5 with some additional data obtained with 50 mm gauge samples. This shows that ultimate tensile strength values of at least 680 MPA and elongation-to-break of at least 10% are also measured for 50 mm gauge samples.

Figure 8:
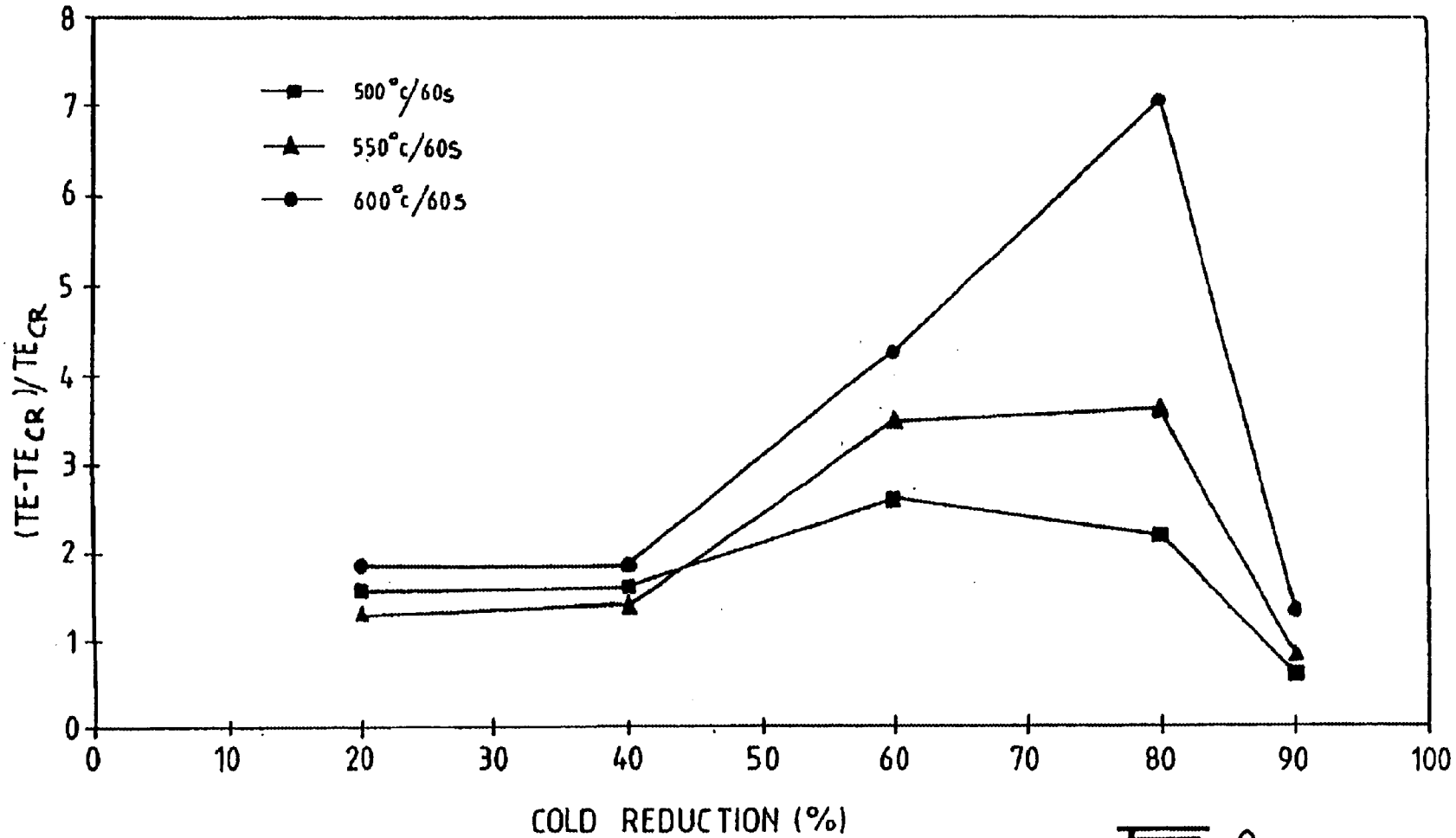
Figure 9:
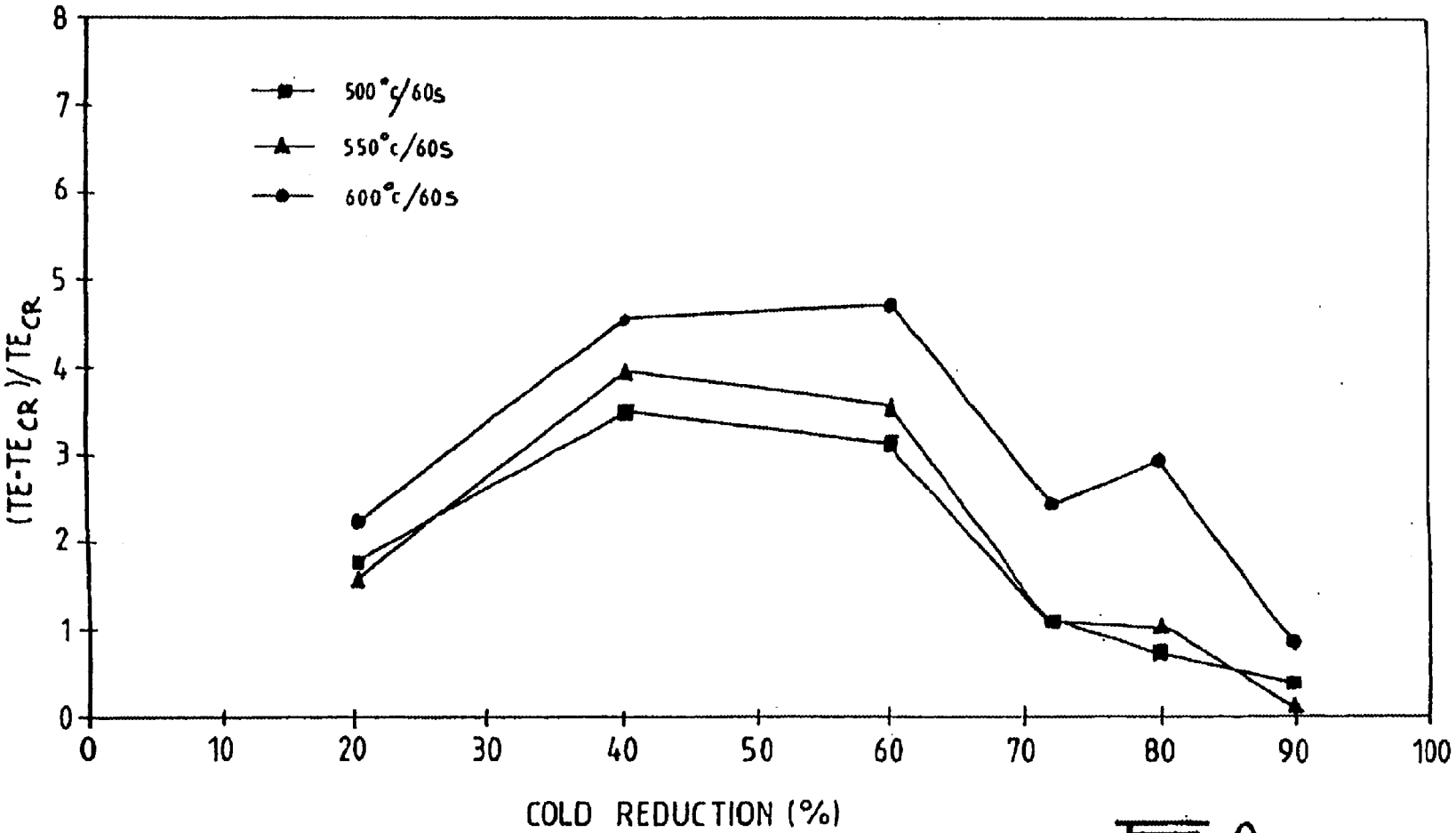

FIGS. 8 and 9 show the increased recovery effects on total elongation with increased annealing temperatures in the range from 500° C. to 600° C.

FIG. 8 is derived from data initially presented in FIG. 4 and plots the ratio of increased elongation on annealing for differing percentages of cold reduction and that annealing temperatures of 500° C., 550° C. and 600° C.

FIG. 9 plots equivalent values obtained from the initially hot rolled strips as initially plotted in FIG. 5.

No recrystallisation was observed except in the case of the samples subjected to 80% and 90% cold reduction and 600° C. annealing temperature. Even in these cases there was less than 10% re-crystallisation. The data plotted on FIGS. 8 and 9 indicates that the maximum elongation recovery effect is achieved at 80% cold reduction on as cast strip and at around 60% cold reduction on initially hot rolled strip.

Figure 10:
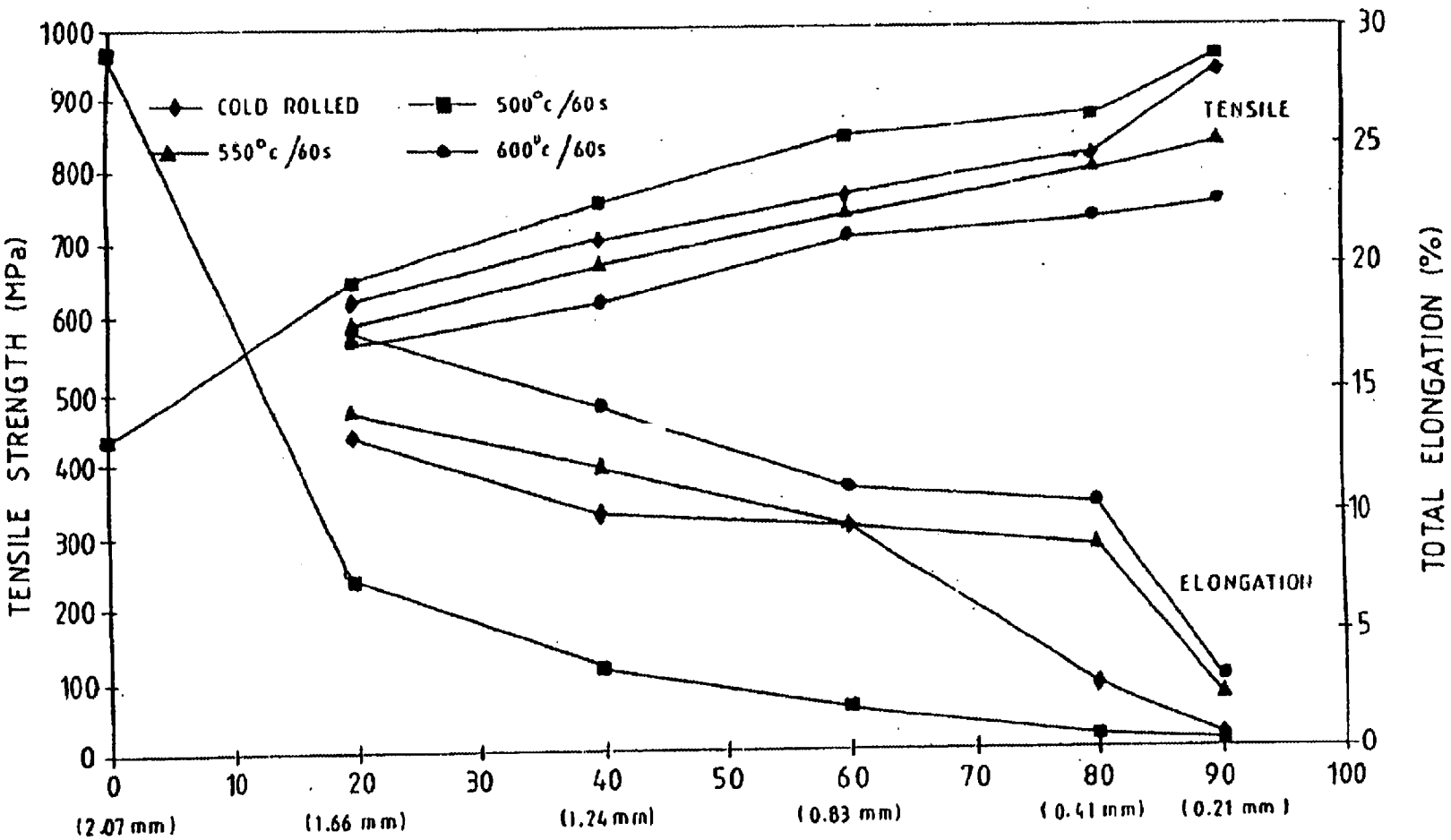
Figure 11:
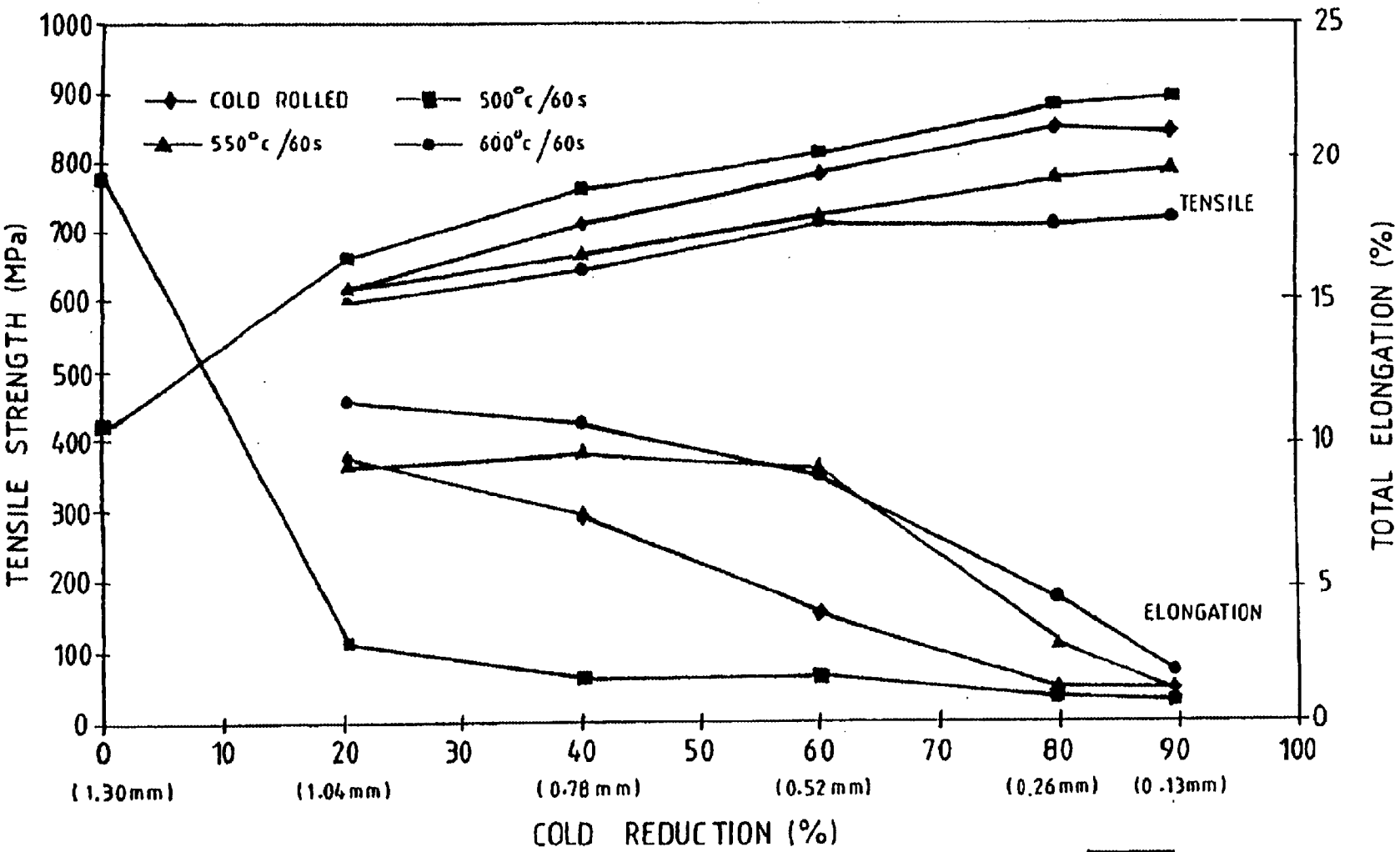

FIGS. 10 and 11 plot data obtained from a series of experiments carried out with plain carbon steel strip samples produced at different casting speeds resulting in different initial microstructure and different initial elongation properties in the as cast strip. The steel was a silicon/manganese killed steel of essentially the same composition as for the previous experiments which produced the data of FIGS. 4 to 9.

FIG. 10 plots tensile strength values obtained on 50 mm gauge samples of 2.07 mm strip which was cast at a casting speed of 37 m/min and had an initial elongation-to-break of around almost 30% in the as cast condition, the strip then being subjected to cold reductions of 20%, 40%, 60%, 80% and 90% and subsequent annealing at temperatures of 500° C., 550° C. and 600° C.

FIG. 11 plots comparable results obtained from 50 mm gauge samples of a cast strip cast at a casting speed of 100 m/min and having an initial thickness of 1.30 mm and an initial total elongation-to-break of around 20% in the as cast condition. The data plotted in FIGS. 10 and 11 shows that with a high elongation starting material it is possible to achieve tensile strengths of 700 MPa and elongation-to-break values in the range 8% to 12% with up to 80% cold reduction. However, with a low elongation starting material (about 20% elongation), it is necessary to limit the cold reduction to a maximum of 60%. It is possible to promote high elongation in the as cast material by increasing the temperature at which the strip is coiled. For this reason, it may be desirable that the coiling temperature be in excess of 650° C. More particularly, coiling temperatures of at least 700° C. may be desirable.

Figure 12:
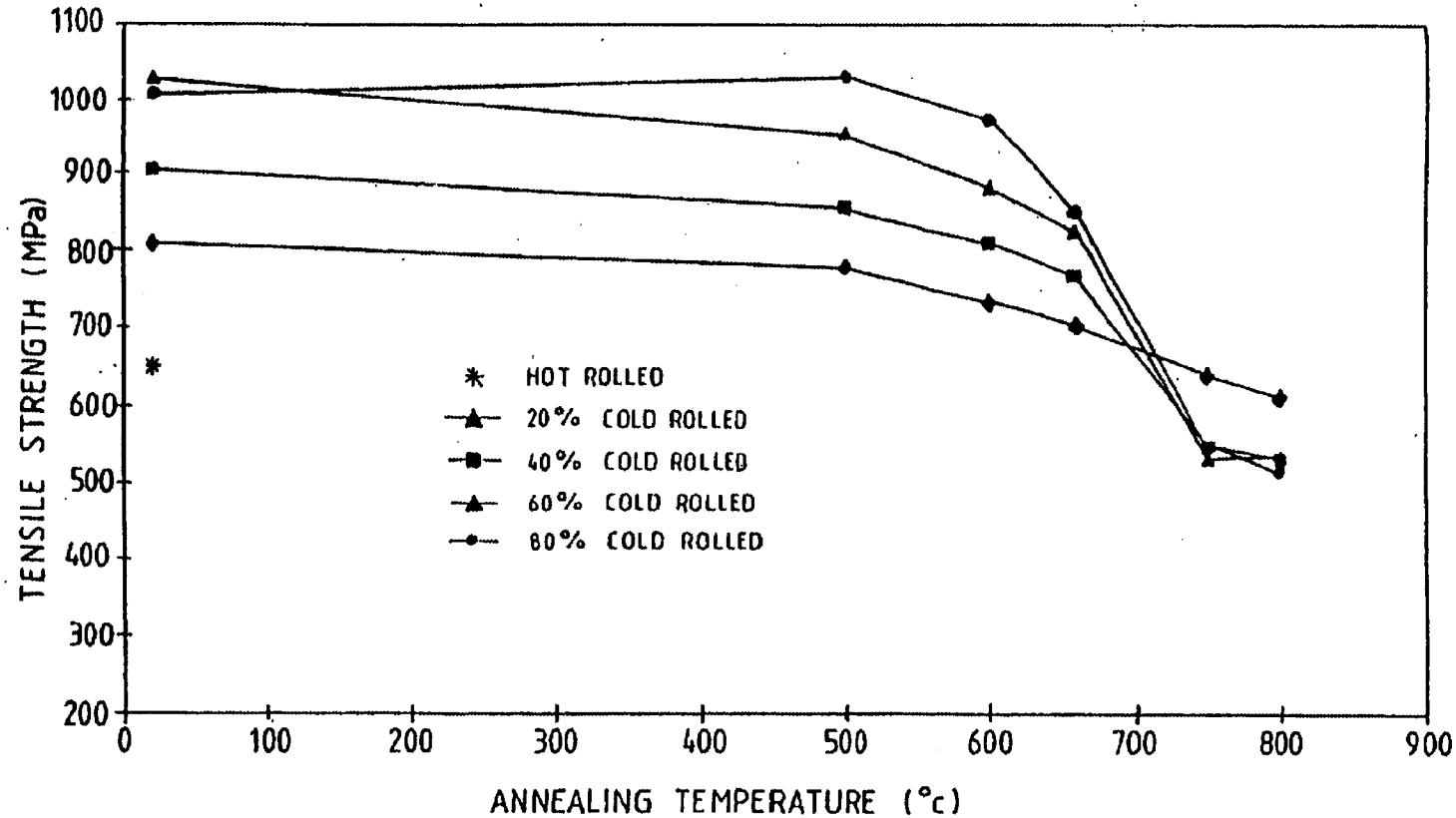
Figure 13:
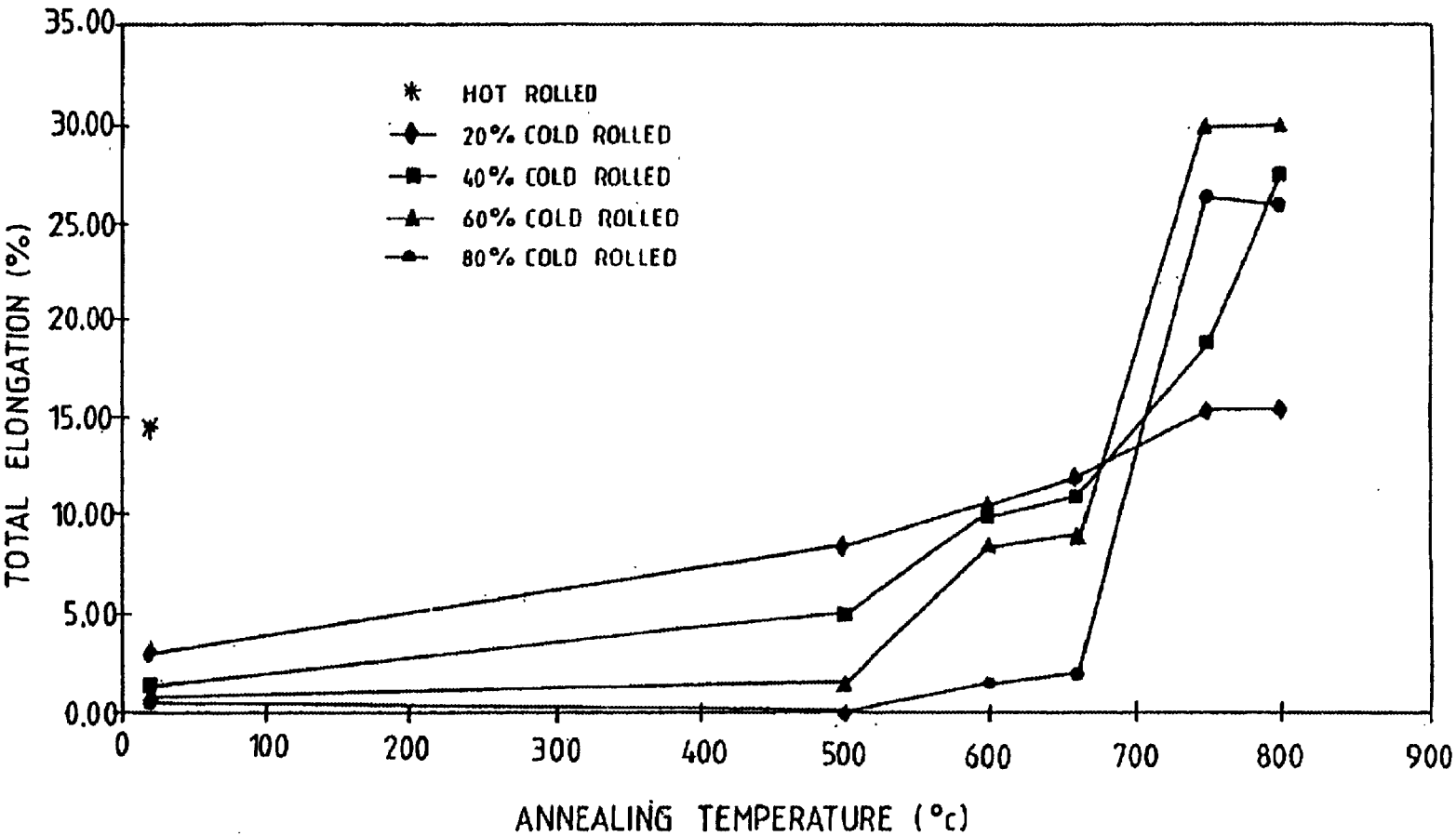

FIGS. 12 and 13 provide data obtained from experiments on strip produced by twin roll casting from a silicon/manganese killed plain carbon steel with high residuals, specifically a steel having the maximum residuals of 0.2 Cr, 0.2 Ni, 0.2 Mo, 0.2 Sn and 0.5 Cu. The strip was cast at a casting speed of 55 m/min and was in-line hot rolled to a 25% reduction at 1050° C. Various samples from the hot rolled coil were then cold rolled to 20%, 40%, 60% and 80% reduction and annealed at various annealing temperatures from 500° C. to 800° C. FIG. 12 shows the evolution of measured tensile strength of the samples during annealing and FIG. 13 shows the evolution of total elongation during annealing. This data shows tensile strength values of 700 to 850 MPa and elongation values in the range 8% to 12% (on a 50 mm gauge) for a range of cold rolling reductions of 20% to 60% at annealing temperatures of 600° C. to 660° C. Residuals severely retarded the onset of recrystallisation thereby allowing high annealing temperatures of 600° C. to 660° C. to be employed without any observable recrystallization during annealing. These results show residuals can be extremely beneficial and can produce an extended range of properties. Moreover, the inclusion of high residuals can offset reduced work hardening with lower manganese and silicon contents and may even permit the required balance of tensile strength and elongation values to be achieved with aluminium killed plain carbon steel.

While the invention has been illustrated and described in detail in the drawings and foregoing description, the same is to be considered as illustrative and not restrictive in character, it being understood that only certain illustrative embodiments have been shown and described and that all changes and modifications that come within the spirit of the invention are desired to be protected.

What is claimed is:

1. A plain carbon steel strip having an ultimate tensile strength of at least 680 MPa and an elongation to break in the range 8% to 12%.

2. The plain carbon steel strip as claimed in claim 1, having a tensile strength of at least 700 MPa.

3. The plain carbon steel strip as claimed in claim 1, having a thickness in the range 0.2 mm to 1.0 mm.

4. The plain carbon steel strip as claimed in claim 1, and having an elongation to break of at least 10%.

5. The plain carbon steel strip as claimed in claim 1, wherein the plain carbon steel is a silicon/manganese killed steel having the following composition by weight:

| | |
|---|---|
| Carbon | 0.02–0.08% |
| Manganese | 0.03–0.80% |
| Silicon | 0.10–0.40% |
| Sulphur | 0.005–0.05% |
| Aluminum | less than 0.01%. |

6. A plain carbon steel strip as claimed in claim 5, wherein the steel has a manganese content of about 0.6% and a silicon content of about 0.3% by weight.

7. The plain carbon steel strip as claimed in claim 2, having a thickness in the range 0.2 mm to 1.0 mm.

8. A plain carbon steel strip having an ultimate tensile strength of at least 680 MPa and an elongation to break of at least 8%.

9. The plain carbon steel strip as claimed in claim 8, having a tensile strength of at least 700 MPa.

10. The plain carbon steel strip as claimed in claim 8, having a thickness in the range 0.2 mm to 1.0 mm.

11. The plain carbon steel strip as claimed in claim 8, and having an elongation to break of at least 10%.

12. The plain carbon steel strip as claimed in claim 8, wherein the plain carbon steel is a silicon/manganese killed steel having the following composition by weight:

| | |
|---|---|
| Carbon | 0.02–0.08% |
| Manganese | 0.03–0.80% |
| Silicon | 0.10–0.40% |
| Sulphur | 0.005–0.05% |
| Aluminum | less than 0.01%. |

13. The plain carbon steel strip as claimed in claim 12, wherein the steel has a manganese content of about 0.6% and a silicon content of about 0.3% by weight.

14. The plain carbon steel strip as claimed in claim 2, and having an elongation to break of at least 10%.

15. The plain carbon steel strip as claimed in claim 3, and having an elongation to break of at least 10%.

16. The plain carbon steel strip as claimed in claim 2, wherein the plain carbon steel is a silicon/manganese killed steel having the following composition by weight:

| | |
|---|---|
| Carbon | 0.02–0.08% |
| Manganese | 0.03–0.80% |
| Silicon | 0.10–0.40% |
| Sulphur | 0.005–0.05% |
| Aluminum | less than 0.01%. |

17. The plain carbon steel strip as claimed in claim 3, wherein the plain carbon steel is a silicon/manganese killed steel having the following composition by weight:

| | |
|---|---|
| Carbon | 0.02–0.08% |
| Manganese | 0.03–0.80% |
| Silicon | 0.10–0.40% |
| Sulphur | 0.005–0.05% |
| Aluminum | less than 0.01%. |

18. The plain carbon steel strip as claimed in claim 4, wherein the plain carbon steel is a silicon/manganese killed steel having the following composition by weight:

| | |
|---|---|
| Carbon | 0.02–0.08% |
| Manganese | 0.03–0.80% |
| Silicon | 0.10–0.40% |
| Sulphur | 0.005–0.05% |
| Aluminum | less than 0.01%. |

.

* * * * *